United States Patent [19]

Morita et al.

[11] 4,059,143

[45] Nov. 22, 1977

[54] METHOD OF AND A MEANS FOR POURING MOLTEN METAL IN A DIE CASTING DEVICE

[75] Inventors: Akiyoshi Morita; Tamio Hayasaka; Kunio Shimizu; Tokiharu Fukuda, all of Toyota, Japan

[73] Assignee: Toyota Jidosha Kogyo Kabushiki Kaisha, Toyota, Japan

[21] Appl. No.: 643,168

[22] Filed: Dec. 22, 1975

[30] Foreign Application Priority Data

Sept. 3, 1975 Japan ..... 50-106705

[51] Int. Cl.[2] ..... B22D 17/30

[52] U.S. Cl. ..... 164/113; 164/312

[58] Field of Search ..... 164/113, 312, 314, 315, 164/133, 303; 141/331, 333

[56] References Cited

U.S. PATENT DOCUMENTS

| | | | |
|---|---|---|---|
| 822,854 | 6/1906 | Cosgrave | 141/331 X |
| 2,519,739 | 8/1950 | Butner | 164/314 |
| 3,344,848 | 10/1967 | Hall et al. | 164/312 |
| 3,515,203 | 6/1970 | Parlanti et al. | 164/312 |

FOREIGN PATENT DOCUMENTS

| | | | |
|---|---|---|---|
| 412,697 | 2/1946 | Italy | 164/315 |

*Primary Examiner*—Robert D. Baldwin

*Attorney, Agent, or Firm*—Birch, Stewart, Kolasch and Birch

[57] ABSTRACT

In pouring molten metal in a die casting device wherein a shot sleeve for supplying molten metal in a die cast mold is substantially horizontally arranged, a guide means for conducting molten flow is obliquely removably inserted into said shot sleeve through an opening provided at a top portion of said shot sleeve so as to guide a flow of molten metal directly into a molten holding space provided at a forward end portion of said shot sleeve.

14 Claims, 5 Drawing Figures

METHOD OF AND A MEANS FOR POURING MOLTEN METAL IN A DIE CASTING DEVICE

BACKGROUND OF THE INVENTION

1. Field of the Invention

The present invention relates to a method of and an apparatus for pouring molten metal in a die casting device, particularly a horizontal die casting device wherein a shot sleeve for supplying the molten metal into a die cast mold is substantially horizontally arranged.

2. Description of the Prior Art

In a die casting device of the horizontal type, a shot sleeve for supplying molten metal into a die cast mold is substantially horizontally arranged and molten metal is poured into the shot sleeve from an opening provided at a top portion of said shot sleeve. The molten metal poured into the shot sleeve is then driven by a piston adpated to be reciprocated in said shot sleeve to be injected into the die cast mold at a relatively high speed and pressure, thereby forming a die cast product in said mold. A horizontal die casting device of this type is widely used for producing die cast products from a metal having a relatively low melting temperature such as aluminium alloys or magnesium alloys which are usually poured at a relatively low temperature, in the order of 700° C. In recent years, however, because of the high precision and productivity obtained by die casting, it is contemplated to produce die cast products from a metal having a relatively high melting temperature such as above 1000° C, e.g., casting iron or casting steel. However, since the shot sleeve in the conventional horizontal die casting device is generally made of a hot tool steel like the SKD-61 according to the Japanese Industrial Standard, if the high temperature molten metal such as cast iron or cast steel is poured therein, it will be damaged in a very short time due to melting by the high temperature, thereby making it impractical to really employ the die casting method. Particularly, the portion of the shot sleeve located below the opening through which the molten metal is poured into the shot sleeve will be seriously attacked by erosion due to the falling flow of molten metal thereby making it difficult to reciprocate the piston in the shot sleeve causing the biting-off or abrasion of a tip portion of the piston and finally, completely obstructing the reciprocation of the piston. Furthermore, the inside surface of the shot sleeve will also be damaged by melting due to the high temperature thereby causing abrasion or thermal fatigue.

In order to avoid the abovementioned problems, it might be contemplated to form the shot sleeve from a high temperature resistive material like a molybdenum alloy or a tungsten alloy so as to improve the thermal resistivity of the inner surface of the shot sleeve. In this case, however, the thermal conductivity of the shot sleeve is increased and the problem that the molten metal poured into the shot sleeve solidifies in a very short time will be brought about.

SUMMARY OF THE INVENTION

Therefore, it is the object of the present invention to solve the abovementioned problems and to provide an improved method and apparatus for pouring molten metal in the horizontal die casting device which enables the die casting device to operate satisfactorily to produce die cast products from a metal of high melting temperature without causing abrasion or damage of the shot sleeve or the piston. Thus, high quality products can be produced by the horizontal die casting device from a metal having a high melting temperature such as cast iron or cast steel.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

According to the present invention, the abovementioned object is accomplished by a method of pouring molten metal in a die casting device wherein a shot sleeve for supplying molten metal into a die cast mold is substantially horizontally arranged, comprising the steps of obliquely inserting a guide means into said shot sleeve through an opening provided at a top portion of said shot sleeve, and pouring molten metal along said guide means toward the inside of said shot sleeve, and by a means for pouring molten metal in a die casting device wherein a shot sleeve for supplying molten metal into a die cast mold is substantially horizontally arranged, comprising a guide means removably and obliquely inserted into said shot sleeve through an opening provided at a top portion of said shot sleeve, said guide means being adapted to guide molten metal to be poured into said shot sleeve.

By employing the abovementioned method and means for pouring molten metal, the molten metal is introduced into the shot sleeve as a quiet flow along an oblique surface provided by said guide means and, therefore, the impact applied by the flow of molten metal to the portion of the shot sleeve located below the conventional pouring opening is substantially reduced when compared with the conventional case wherein the portion is directly attacked by the falling flow of molten metal. Thus, the problems that the lower portion of the shot sleeve located below the pouring opening is damaged in a short period and that the piston is bitten off or seriously worn are effectively avoided. Furthermore, since the entrainment of air into the molten metal due to disturbance thereof in the pouring process is reduced, the quality of the die cast product is improved.

According to a particular feature of the present invention, the angle of inclination of said guide means should preferably be in the order of 10°-60° with respect to the axis of the shot sleeve. If the angle of inclination is larger than 60°, the impact applied by the falling flow of molten metal will become relatively large, while, on the other hand, if the angle of inclination is smaller than 10°, the resistance applied by the molten metal contained in the shot sleeve to said guide means when it is pulled off will become so large that smooth retracting operation thereof will be obstructed.

According to another particular feature of the present invention, said guide means may preferably be arranged to guide the flow of molten metal into a metal holding space provided at an end of the shot sleeve adjacent the die cast mold. By employing this structure, it is avoided that the flow of molten metal is directly ejected against the inner surface of the shot sleeve over which the piston is slided, whereby the possibility of the piston receiving surface of the shot sleeve being damaged by the flow of melting metal is further reduced thereby ensuring to keep a small resistance applied to the moving piston.

According to still another feature of the present invention, said metal holding space may preferably be formed in a tapered shape having a gradually increasing inner diameter toward the die cast mold or in the direction in which the piston is driven. By this arrangement; a proper space is provided between the inner peripheral surface of the metal holding space and the outer peripheral surface of said piston thereby allowing for a clearance effective for avoiding any abrasion or biting-off of the piston being caused even when a small damage has been caused at the inner peripheral surface of the metal holding space due to the impact of the poured molten metal. Thus, the piston is positively protected from being obstructed from its normal reciprocation in said shot sleeve.

BRIEF DESCRIPTION OF THE DRAWING

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Figure 1:
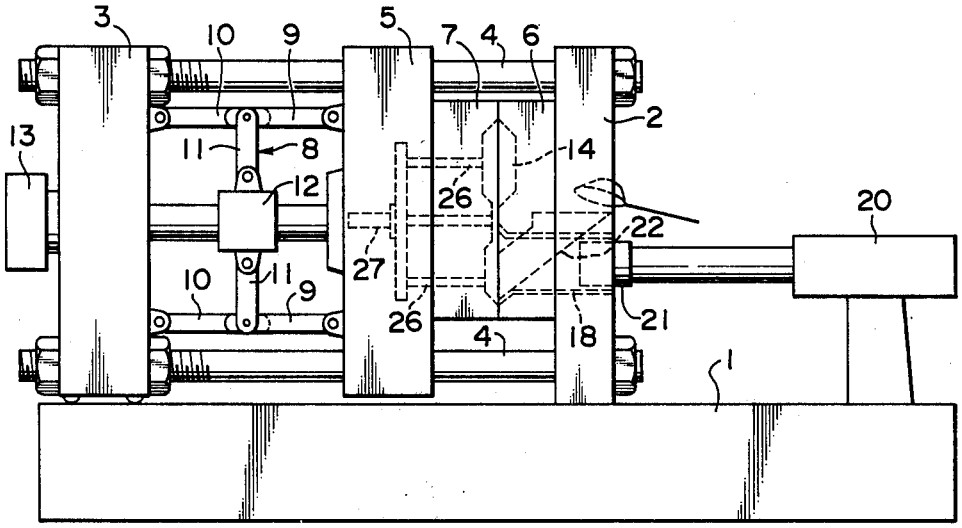
FIG. 1 is a relatively diagrammatic side view of a horizontal die casting device incorporating the means for pouring molten metal according to the present invention.

Referring to FIG. 1, element 1 designates a base plate of a horizontal die casting device, said base plate supporting a stationary platen 2 provided at a central portion thereof. At an end portion of said base plate (leftward in the figure) a holder block 3 is provided and, between the stationary platen 2 and the holder block 3 are provided a plurality of horizontally extending guide bars 4 which carry a movable platen 5 which is slidable along said bars in the axial direction thereof. A stationary mold 6 of a die cast mold is mounted to the stationary platen 2 while a movable mold 7 of the die cast mold is mounted to the movable platen 5. The holder block 3 is firmly connected to the stationary platen 2 to form a unitary structure by means of the guide bars 4 but it is only movably placed on the base plate 1 so that die cast molds having various thickness can be mounted to the die casting device.

A clamping mechanism 8 having a conventional toggle structure is incorporated between the movable platen 5 and the holder block 3 in order to drive the movable platen 5 towards the stationary platen 2. The toggle-type clamp mechanism 8 comprises upper and lower first link elements 9, 9 pivotably mounted to the movable platen 5 and upper and lower second link elements 10, 10 pivotably connected to the holder block 3, said first and second link elements being pivotably connected with each other and with a third link element 11 which is pivotably connected to an actuating block 12 at the other end thereof. The actuating block 12 is reciprocated in the direction parallel to the axes of the guide bars 4 by a cylinder-piston means 13 mounted to the holder block 3 so that when the actuating block 12 is driven toward the movable platen 5, the movable platen 5 is urged toward the stationary platen 2 by the toggle link mechanism composed of said first, second and third link elements.

Figure 2:
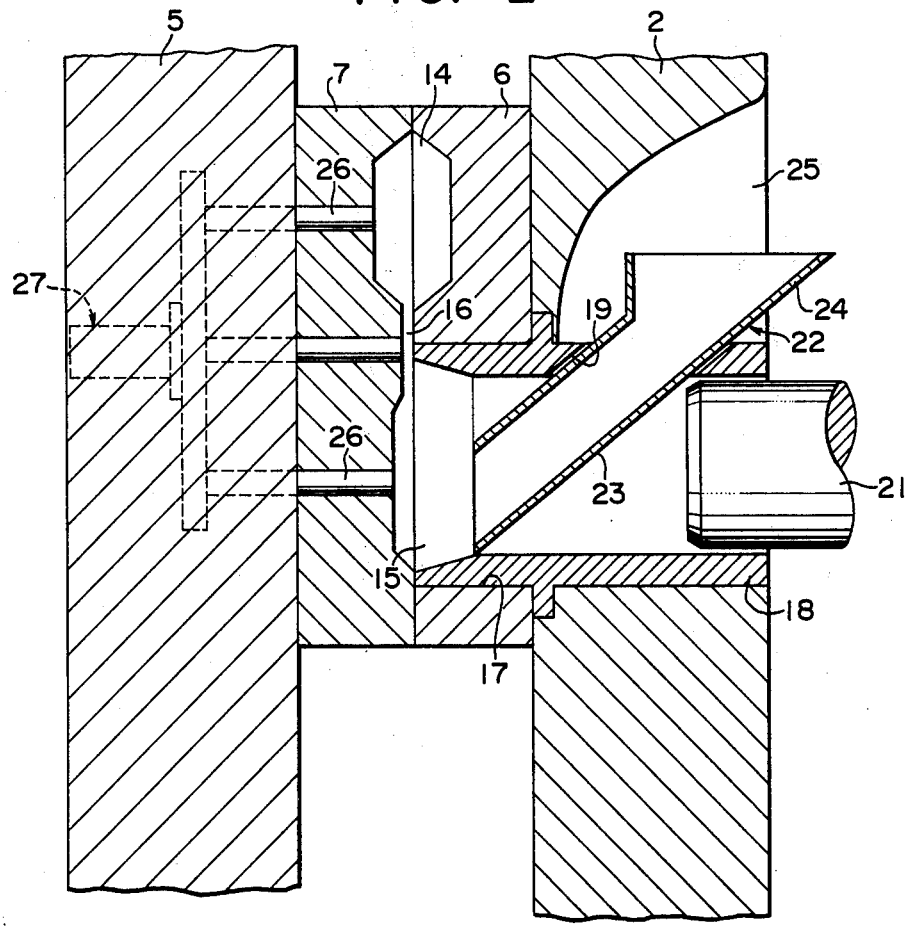
FIG. 2 is an enlarged sectional view of a part of the device shown in FIG. 1 showing particularly the structure for pouring molten metal.

The die cast mold and the structure for pouring molten metal to the mold are shown in FIG. 2 in more detail. The die cast mold comprises a stationary mold 6 and a movable mold 7 which, in cooperation, define a molding cavity 14. The molding cavity is connected with a molten metal holding space 15 by way of a passage 16 which is formed adjacent the contacting surfaces of said stationary and movable molds. The stationary mold 6 is formed with a bore 17 adapted to receive an end portion of a shot sleeve 18 which is horizontally inserted through a corresponding bore formed in the stationary platen 2. The shot sleeve 18 is formed with an oblique opening 19 at a top portion thereof and receives a piston 21 to be reciprocable therein, said piston being operated by a cylinder-piston means 20 mounted on the base plate 1. The forward end of the shot sleeve cooperates with the movable mold 7 to define said molten metal holding space 15. The molten metal holding space 15 is formed in a tapered shape having a gradually increasing inner diameter toward the forward end thereof. The tapering angle should preferably be more than 5°.

A guide means 22 for conducting a flow of molten metal is removably inserted into the shot sleeve through said opening 19 with an inclination with respect to the axis of the shot sleeve. The guide means 22 comprises a tube portion 23 and a funnel portion 24 connected to the upper end of said tube portion to open upward. The guide means is adapted so that when it has been obliquely inserted into the shot sleeve, the forward end of the tube portion is placed just to open toward the molten metal holding space 15 and, as shown in the drawings, the lower outlet portion contacts the bottom portion of the shot sleeve. The guide means 22 is preferably made of a material which is non-reactive to the hot molten metal traveling therethrough and has a low thermal conductivity so as not to cool the molten metal while it is being conducted thereby. The opening 19 should preferably be provided as close to the stationary mold 6 as possible and it is to be formed obliquely as shown in the figure so that the guide means 22 can be smoothly inserted into or removed from the shot sleeve in its inclined position. In the embodiment shown in FIG. 2, the opening 19 is provided at a portion of the shot sleeve which penetrates the stationary platen 2 and, in this connection, the stationary platen 2 is provided with a cut-out space 25 for allowing the guide means 22 to be inserted or removed through the opening 19.

In FIG. 2, elements 26 designate ejector pins which are adapted to be actuated by an ejector mechanism 27 incorporated in the movable platen 5. The ejector pins 26 operate to remove the die cast products from the die mold after they have been cast.

In operation, as the first step, the toggle-type clamp mechanism 8 is actuated to clamp the die cast mold and, thereafter, the guide means 22 is inserted into the shot sleeve 18 through the opening 19. Then, molten metal is poured to the guide means 22 or, more particularly, to the funnel portion 24 thereof. The molten metal is then conducted through the inclined tube portion 23 toward the inside of the molten metal holding space 15. After a predetermined amount of molten metal has been supplied, the guide means 22 is removed from the shot sleeve 18. Thereafter, the cylinder-piston means 20 is actuated to drive the piston 21 in the shot sleeve at a predetermined speed to charge the molten metal supplied into the shot sleeve to the cavity 14 through the passage 16. In this case, it is desirable that the speed of advancing the piston 21 is relatively low until the piston closes the opening 19 so that the molten metal does not snap out from the opening 19 and, after the piston 21 has closed the opening 19, the advancing action of the piston is expedited. When molten metal has been charged in the cavity 14 and solidified, the clamping toggle mechanism 8 is actuated to remove the movable mold 7 from the stationary mold 6. Simultaneously, the ejector pins 26 are actuated to eject the die cast products from the mold. Since the molten metal holding space 15 is formed in the tapered shape, the solidified residual metal remaining in the hold space 15 or the so-called biscuit readily removed from the hold space.

Figure 3:
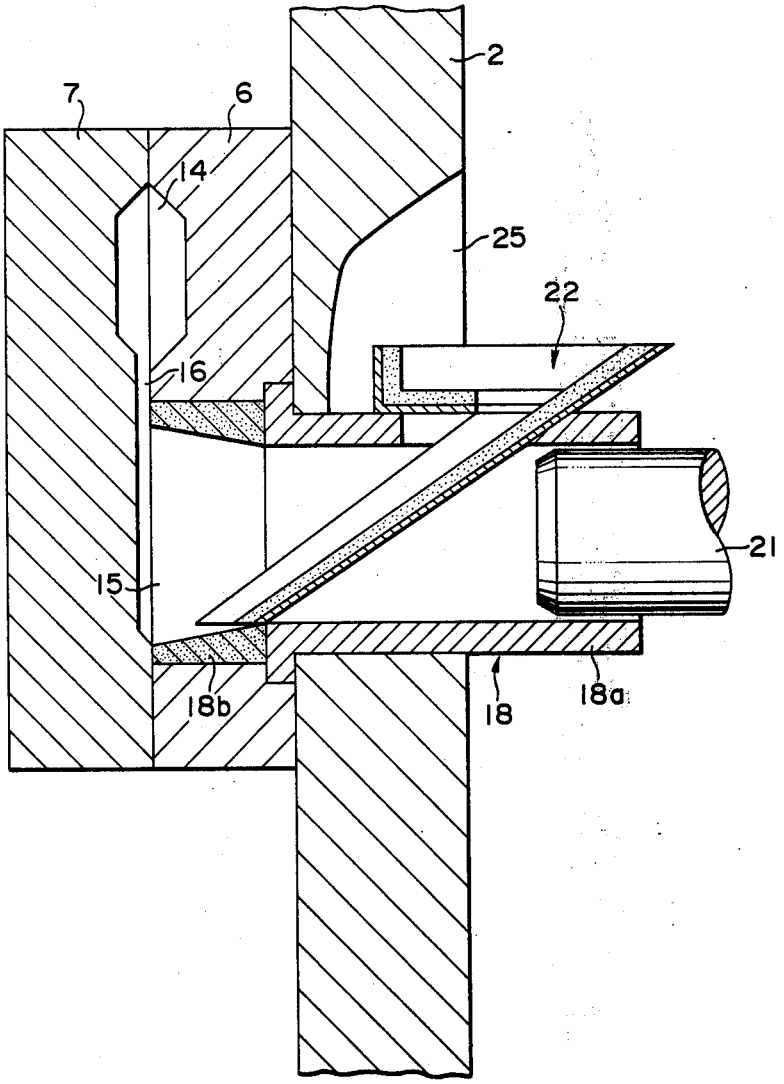
FIG. 3 is a view similar to FIG. 2 showing another embodiment of the structure for pouring molten metal.

FIG. 3 is a view similar to FIG. 2 but shows a modification of the metal pouring structure as explained above. In this modification, the shot sleeve 18 comprises a cylinder portion 18*a*, which is to receive the piston 21 and a tip portion 18*b* which is to form the molten metal holding space 15. In this structure, the cylinder portion 18*a* and the tip portion 18*b* can be formed of different materials each complying with a particular requirement for the individual portion. In this embodiment, the guide means 22 is also modified to have a trough portion instead of the aforementioned tube portion for conducting a flow of molten metal. In FIG. 3 the portions corresponding to those shown in FIG. 2 are designated by the same reference numerals as in FIG. 2, and therefore, detailed explanations for these portions will be omitted for the purpose of simplicity.

Figure 4:
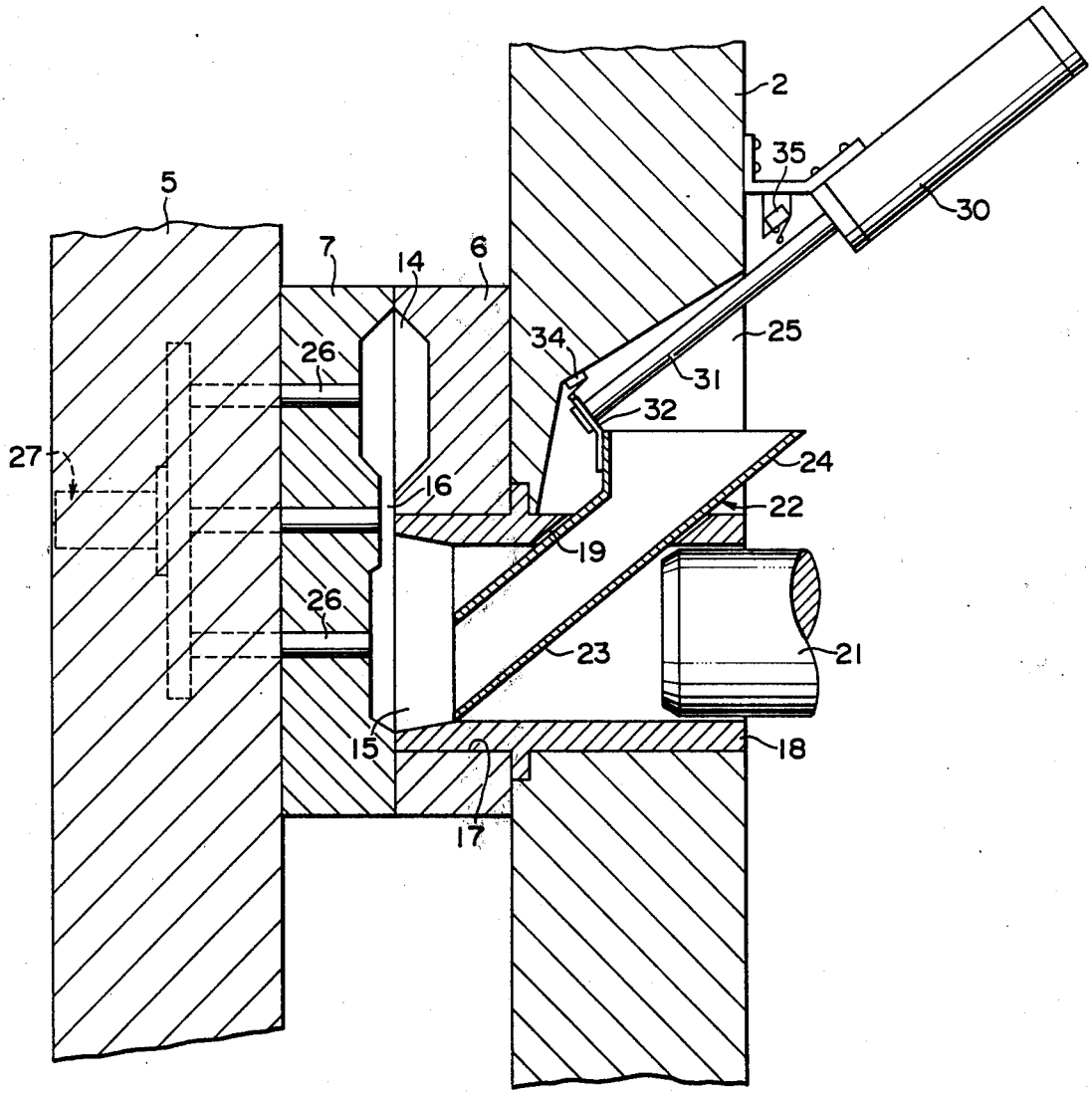
FIG. 4 is a view similar to FIG. 2 showing a modification of the means for pouring molten metal incorporating an automatically actuating mechanism for reciprocating the guide means for pouring metal; and, FIG. 5 is a view showing an electric circuit for accomplishing a sequential operation of the horizontal die casting device incorporating said automatically actuating mechanism for reciprocating the guide means for pouring molten metal.

FIG. 4 is a view similar to FIG. 2 but shows another embodiment wherein the insertion or retraction of the guide means into and out of the short sleeve is automated. This embodiment comprises a cylinder-piston means 30 mounted to the stationary platen 2. The cylinder-piston means comprises a piston rod 31 arranged to be reciprocable along an oblique axis, said piston rod carrying the guide means 22 by way of a connecting lug 32. In this structure, the guide means 22 is automatically reciprocated by the corresponding operation of the cylinder-piston means 30 so as to be inserted into or removed from the shot sleeve 18 through the opening 19. In this case, the lower terminal position in the insertion and the upper terminal position in the retraction of the guide means 22 are determined by limit switches 34 and 35 respectively.

Figure 5:
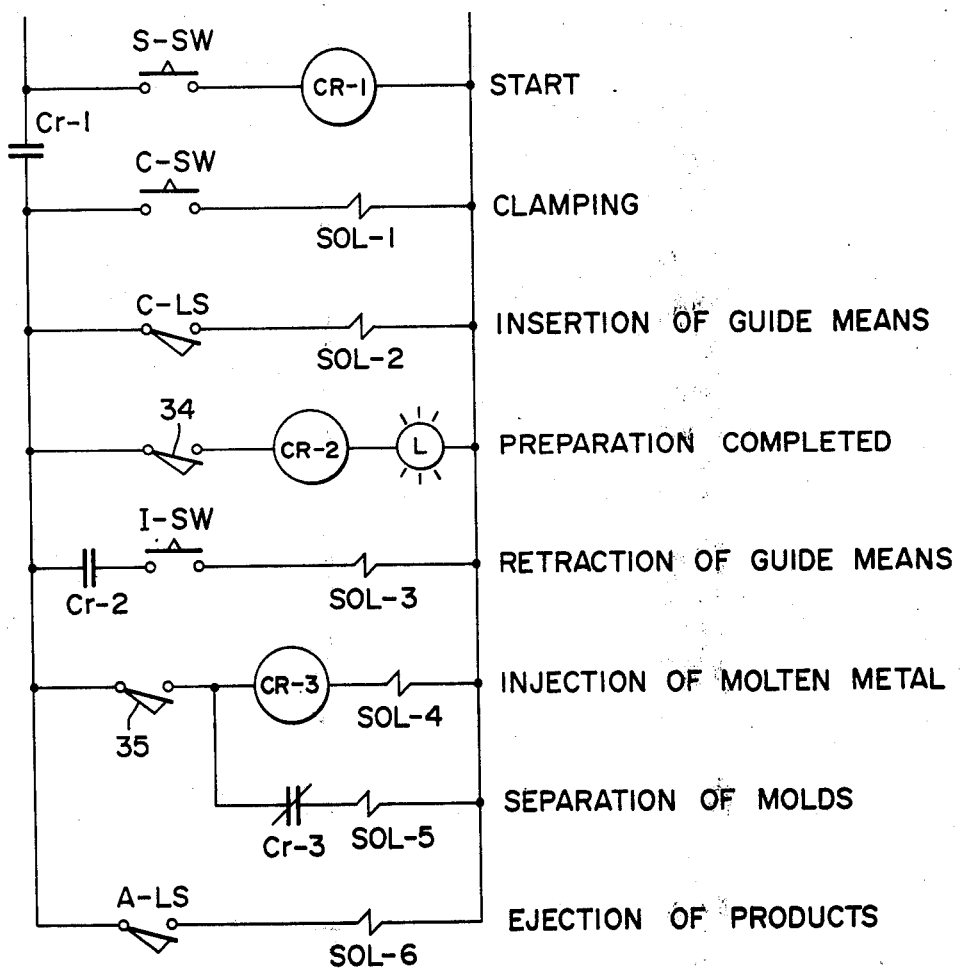

FIG. 5 shows an example of the electric circuit for accomplishing a series of sequential operations of the die casting device which incorporates the automatic reciprocating mechanism for the guide means as shown in FIG. 4. First of all, when a push-button S-SW is pushed to be closed, a relay CR-1 is made "ON" and a make contact *cr*-1 is closed. Then, the clamping push button C-SW is pushed to be closed, whereby a solenoid SOL-1 is energized to actuate the cylinder-piston means 13 to accomplish the clamping action by the clamping toggle mechanism 8. When a predetermined clamping action has been accomplished, a limit switch C-LS which is to indicate the completion of the mold clamping is made "ON" and a solenoid SOL-2 is energized, whereby the cylinder-piston means 30 is actuated to lower and insert the guide means 22 into the shot sleeve 18. When the guide means 22 has been inserted to a predetermined position and the limit switch 34 is made "ON," the operation of the cylinder-piston means 30 is stopped, whereby the guide means 22 is held at the position inserted into the shot sleeve 18. At the same time when said limit switch 34 is made "ON," a relay CR-2 is actuated and its make contact *cr*-2 is closed to put on a lamp L which is to indicate that the preparation has been completed. Then, a predetermined amount of molten metal is supplied into the shot sleeve 18 by way of the guide means 22. Next, an injection push button I-SW is pushed to be closed thereby energizing a solenoid SOL-3. Then, the cylinder-piston means 30 is operated in the reverse direction and the guide means 22 is extracted from the shot sleeve 18 so far that it does not stand in the way of the advancing piston 21. When the guide means 22 has been retracted to a predetermined position, the limit switch 35 is actuated and the reversing operation of the cylinder-piston means 30 is stopped. At the same time as the limit switch 35 is actuated, a timer relay CR-3 is also actuated thereby opening its break contact *cr*-3 thereby actuating a solenoid SOL-4, whereby the cylinder-piston means 20 is actuated to advance the piston 21 in the shot sleeve 18. As the piston 21 advances in the shot sleeve 18, the molten metal supplied in the shot sleeve is urged toward the cavity 14. After the lapse of a predetermined time, the relay CR-3 is released so as to close its break contact *cr*-3. Then, a solenoid SOL-5 is actuated to operate the mold clamping cylinder-piston means 13 in the reverse direction to loosen the clamping toggle mechanism 8 thereby separating the cast mold halves from each other. When the movable mold 7 has been removed from the stationary mold 6 for a predetermined distance, a limit switch A-LS for indicating the completion of mold separation is made "ON" whereby the reversing operation of the cylinder-piston means 13 is stopped and, simultaneously, a solenoid SOL-6 is energized to actuate the ejector mechanism 27 so as to drive the ejector pins 26 in the manner to push the die cast products out of the casting space. Thus, a series of sequential operations has been completed.

When cast iron or various kinds of cast steel are cast by the die casting process, the shot sleeve and the metal driving piston may be made of iron base alloys. For example, the hot tool steels of the series of SKD-5 and SKD-6 according to the Japanese Industrial Standard can be employed. The metal driving piston is generally cooled by a cooling system incorporated therein. However, since the shot sleeve does not generally incorporate any cooling system, the inside surface thereof reaches a temperature above the annealing temperature, whereby the inside surface layer is subject to decarbonization and annealing. Therefore, 50 shots of die casting are the limit to be obtained. For obtaining more shots of die casting, it is considered to be effective to permeate Cr, Al or the like, metal carbine or oxide of these metals or the like by diffusion into the inside surface of the shot sleeve or to paint acetylene smoke carbon on the inside surface of the shot sleeve so as to obtain a heat insulating effect. Or, as an alternative, the shot sleeve may be made of thermal resistive super alloys of Ni or Co base, such as, for example, Rene-41, 713C, Nimonic, etc. As a further alternative, the shot sleeve may be made of a ceramic material such as $Al_2O_3$, $Si_3N_4$, SiC, $ZrB_2$ or composite materials thereof.

In the following, several examples of the horizontal die casting device embodying the metal pouring structure according to the present invention will be explained.

EXAMPLE 1.

The guide means has been formed by sintering a ceramic composed of 98% $Al_2O_3$ and 2% inorganic binder to have inner diameter of 50mm and thickness of 5mm. This material has a low thermal contactivity such as about 2.0Kcal/m hr° C and is less reactive with molten metal. However, since this material has a low rigidity, the outer surface was covered by SUS-310S stainless steel according to the Japanese Industrial Standard. The guide means was preheated at 650° C and inserted into the shot sleeve with the inclination angle of 30°. The sh ot sleeve was composed of a liner having an inner diameter of 60mm, the inner peripheral surface thereof being defined by a 5mm thick layer of Rene-41 (19.1% Cr, 10.9% Co, 10% Mo, 3.28% Ti, 1.54% Al, 0.006% B, 0.09% C and residual Ni), said liner being mounted in an outer tube member made of SKD-51 by thermal shrinkage. By preheating the inner surface of the shot sleeve at about 500° C, acetylene smoke carbon was painted on the inner surface. The metal driving piston was made of SKD-61 and was applied with the Tuftride treatment. The clearance between the piston and the shot sleeve was 0.04mm.

FC 20 cast iron according to the Japanese Industrial Standard was melted by a high frequency furnace and was delivered into a ladle at 1400° C. About 2.0Kg of the molten metal was poured into the shot sleeve by employing the above-mentioned guide means. The pouring time was about 1 second. After the pouring, the guide means was rapidly retracted and the piston was advanced at the rate of 0.1m per second. When the pouring opening of the shot sleeve was completely closed by the piston, the advancing speed of the piston was increased to 0.5m per second, and the metal was charged into the molding cavity. Injection pressure of 600Kg/cm$^2$ was applied and, after 5 seconds, the mold was opened to discharge the product. In this example, more than 100 shots of die casting could be possible.

EXAMPLE 2.

The inner surface layer of the forward end portion of the shot sleeve w here it defines the molten metal holding space was formed of a cermic material which was formed by hot-pressing $Si_3N_4$. This material shows a sufficient strength even at a temperature above 1200° C together with the characters that the thermal expansion ratio is as small as $2.75 \times 10^{-6}$/° C and the reactivity with molten metal is very low. A half cylindrical trough member having a radius of 20mm and thickness of 5mm made of the same ceramic material was employed for the guide means. In this case, the guide means was set with the inclination angle of 40° and preheated at about 750° C. SUS-18 stainless cast steel according to the Japanese Industrial Standard was melted by a high frequency furnace and poured at 1650° C. The metal driving piston was first advanced at the speed of 0.2m per second and then accelerated to 0.7m per second. The injection pressure was set at 1000Kg/cm$^2$.

In this case, the die cast mold was made by forging and tempering TZM alloy (0.5% Ti, 0.08% Zr and residual Mo) After 500 shots, the molten metal holding space and the shot sleeve were inspected but it was not necessary to change the shot sleeve or to apply regrinding thereto.

EXAMPLE 3.

The forward end portion of the shot sleeve where it defines the molten metal holding space was formed of $ZrB_2$-SiC-C ceramic material formed by hot-pressing. The inner surface of the shot sleeve was formed of Co base X-40 alloy. By employing this slot sleeve, a low melting temperature Mn stainless cast steel, In-856 alloy, was cast. The piston advancing speed after its acceleration was 0.9m per second. Then injection pressure was 400 Kg/cm$^2$. As a result, products of a good quality were obtained. Since this alloy has a relatively low melting temperature such as 1260° C and a good separability against the casting mold, continuous casting by the cycle time below 30 seconds was possible. After 200 shots, the shot sleeve was inspected for fatigue or melting but no damage was found.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method for pouring molten metal in a die casting device wherein a shot sleeve for supplying molten metal to a die cast mold is substantially horizontally disposed in the die casting device, comprising the steps of obliquely inserting an inclined guide means into said shot sleeve through an opening provided in a top portion of said shot sleeve to the extent that the lower outlet end of said guide means contacts a bottom portion of said shot sleeve, and pouring molten metal along said guide means toward the inside of said shot sleeve as a quiet flow.

2. The method of claim 1, wherein said shot sleeve is inclined at an angle of between 10°-60° with respect to the axis of said shot sleeve.

3. The method of claim 1, wherein the molten metal is conducted by said shot sleeve directly to a molten metal holding space provided at a forward end of said shot sleeve.

4. An apparatus for pouring molten metal in a die casting device wherein a shot sleeve for supplying molten metal into a die cast mold is substantially horizontally arranged, comprising an inclined guide means removably and obliquely disposed in said shot sleeve through an opening provided in a top portion of said shot sleeve to the extent that the lower outlet portion of said guide means contacts the bottom portion of said shot sleeve, said guide means being adapted to guide molten metal into said shot sleeve as a quiet flow.

5. The apparatus according to claim 4, wherein said guide means is inclined at an angle of between 10°-60° with respect to the axis of said shot sleeve.

6. The apparatus of claim 4, wherein the lower outlet end of said guide means is positioned to closely face a molten metal holding space provided at the forward end portion of said shot sleeve.

7. The apparatus of claim 4, wherein a cylinder piston means is operatively associated with said guide means for automatically inserting and removing said guide means from said shot sleeve.

8. The apparatus of claim 4, wherein said guide means comprises a tube portion and a funnel portion, said latter portion being connected to an end of said former portion.

9. The apparatus of claim 4, wherein said guide means comprises a trough portion and a funnel portion, said latter portion being connected to an end portion of said former portion.

10. The apparatus of claim 4, wherein a forward end portion of said shot sleeve where it defines a molten metal holding place is formed as an individual element separated from the remaining portion of said shot sleeve, said element being made of a material different from the material forming said remaining portion.

11. The apparatu s of claim 4, wherein a forward end portion of said shot sleeve, where it defines a molten metal holding space, is formed in a tapered shape to have a gradually increasing inner diameter toward the forward end thereof.

12. In a die casting apparatus comprising a stationary platen and a movable platen, means for moving said movable platen toward said stationary platen to define a molding cavity therebetween, a molten metal holding space disposed adjacent said molding cavity and communicating with said molding cavity and a substantially horizontally disposed shot sleeve communicating with said molten metal holding space, said shot sleeve being adapted to accommodate a piston means, the improvement which comprises an opening in the upper portion of said shot sleeve and a removable inclined guide means in said opening, said guide means being obliquely disposed i n said opening and extending to contact the bottom portion of said shot sleeve whereby molten metal may be poured thereinto as a quiet flow.

13. The apparatus of claim 12, wherein means are provided for automatically inserting and removing said guide means.

14. The apparatus of claim 12, wherein the diameter of the shot sleeve increases where it communicates with the molten metal holding space.

* * * * *